US007563322B2

(12) United States Patent
Loth

(10) Patent No.: US 7,563,322 B2
(45) Date of Patent: Jul. 21, 2009

(54) METHOD AND APPARATUS FOR ONLINE FLOW CONTROL OVER THE SPAN OF A HIGH ASPECT RATIO SLOT JET

(75) Inventor: John L. Loth, Morgantown, WV (US)

(73) Assignee: West Virginia University

( * ) Notice: Subject to any disclaimer, the term of this patent is extended or adjusted under 35 U.S.C. 154(b) by 208 days.

(21) Appl. No.: 11/784,645

(22) Filed: Apr. 9, 2007

(65) Prior Publication Data

US 2008/0245903 A1 Oct. 9, 2008

(51) Int. Cl.
*B05C 13/00* (2006.01)

(52) U.S. Cl. ..... 118/63; 118/68

(58) Field of Classification Search ..... 118/63, 118/62, 66–68; 15/405; 239/597
See application file for complete search history.

(56) References Cited

U.S. PATENT DOCUMENTS

| | | | | |
|---|---|---|---|---|
| 2,139,628 | A | | 12/1938 | Terry |
| 2,940,418 | A | | 6/1960 | Penrod et al. |
| 3,022,016 | A | | 2/1962 | Shrewsbury |
| 3,141,194 | A | | 7/1964 | Jester |
| 3,314,163 | A | | 4/1967 | Kohler |
| 3,459,587 | A | | 8/1969 | Hunter et al. |
| 3,499,418 | A | | 3/1970 | Mayhew |
| 3,630,453 | A | | 12/1971 | Lane et al. |
| 3,750,955 | A | | 8/1973 | Nakai et al. |
| 3,753,418 | A | | 8/1973 | Roncan |
| 3,841,557 | A | | 10/1974 | Atkinson |
| 3,917,888 | A | | 11/1975 | Beam et al. |
| 3,932,683 | A | | 1/1976 | Robins et al. |
| 3,970,192 | A | | 7/1976 | von Wolffradt |
| 3,977,359 | A | | 8/1976 | Bottaro |
| 4,041,895 | A | * | 8/1977 | Overton et al. ..... 118/704 |
| 4,153,006 | A | | 5/1979 | Thornton |
| 4,270,702 | A | | 6/1981 | Nicholson |
| 4,321,884 | A | | 3/1982 | Barkley |
| 4,346,129 | A | | 8/1982 | Decker et al. |
| 4,513,915 | A | | 4/1985 | Kohler et al. |
| 4,515,313 | A | | 5/1985 | Cavanagh |
| 4,524,716 | A | | 6/1985 | Mueller |
| 4,697,542 | A | | 10/1987 | Kohler et al. |
| 4,708,629 | A | | 11/1987 | Kasamatsu |
| 5,064,118 | A | | 11/1991 | Lauricella |
| 5,346,551 | A | | 9/1994 | Pannenbecker et al. |
| 5,401,317 | A | | 3/1995 | Cox et al. |
| 5,609,305 | A | | 3/1997 | Webb |
| 5,614,266 | A | | 3/1997 | Cox et al. |
| 5,683,514 | A | | 11/1997 | Cox et al. |
| 6,010,078 | A | | 1/2000 | Eberhardt et al. |

* cited by examiner

*Primary Examiner*—Brenda A Lamb
(74) *Attorney, Agent, or Firm*—Gary J. Morris

(57) ABSTRACT

A method and apparatus for controlling local flow along a slot jet with applications to airknives is disclosed. The airknife provides improved options for on-line control over coating thickness and edge build-up prevention. The gap of the slot nozzle of the airknife can remain constant while the outflow pattern is controlled by a series of preset throttle valves in combination with a single moving component, the multi-port aero-valve. This valve can be actuated locally or remotely, in rotation or translation, thereby changing gradually from a conventional uniform outflow to one which increases in velocity and mass flow rate along the airknife span to produce a bow effect. The valve can also change gradually from a conventional uniform outflow to one which increases in velocity, mass flow rate and outflow angle along the span to simulate bow effect in combination with fan-like outflow.

14 Claims, 7 Drawing Sheets

METHOD AND APPARATUS FOR ONLINE FLOW CONTROL OVER THE SPAN OF A HIGH ASPECT RATIO SLOT JET

BACKGROUND OF THE INVENTION

The embodiments of this invention generally relate to online flow control along the span of a high aspect ratio slot jet with applications to airknives as used in industry to apply coatings, dry coatings or to control the thickness of coatings. Most problematic is controlling the coating thickness distribution in the hot-dip galvanizing industry, where excess zinc coating of sheet steel is an expensive waste of material. With frequent changes in sheet thickness-width-and-speed, together with changes in furnace temperature, zinc pot temperature-and-chemical composition, coating thickness control is an ongoing problem for the operator. Currently the operator's options are limited to changing sheet speed, airknife supply pressure, distance between slot jet and sheet, and the blowing angle onto the sheet. To prevent coating edge buildup with associated coiling problems of the finished sheet goods and to improve coating uniformity, the operator has the option to change offline, the "bow" setting in the slot jet nozzle lips. To change the bow setting offline requires taking the slot jet to a machine shop for nozzle lip gap adjustment. A "bow" setting in the slot jet nozzle lip gap, is used to increase the jet mass flow rate or momentum, and thereby the wiping action, towards the edges of the sheet where the lack of flow blockage deflects the flow outward, thereby locally reducing the stagnation pressure on the sheet and thus wiping action.

Airknife technologies from the 1990's incorporated online controllable internal swiveling elbows to produce a fan shaped outflow angle of the airknife slot jet. This method proved to be effective in reducing edge build-up. However this mechanism was complex with numerous moving parts and often unreliable. After fixing the position of the outflow generating elbows, such airknives remained in service over the past two decades. Other operators resort to: (1) fences placed near the edges of the sheet to minimize edge build-up and coiling problems or (2) a bow-like setting in the airknife lips, to increase the mass flow rate and thus wiping action near the sheet edges. Figures from U.S. Pat. No. 5,683,514 are shown in FIG. 5 to illustrate the obtainable fan-like outflow pattern by adding swiveling elbows inside the airknife inlet plenum. The ever increasing cost of coating materials increases the demand for new technologies with online control over coating thickness distribution. This is likely to be in the form of online control over the distribution of any or all local mass flow rate or velocity or outflow angle along the length (span) of the slot jet of an airknife.

THEORY OF OPERATION

Herein is disclosed a "Method and Apparatus for Online Flow Control Over the Span of a High Aspect Ratio Slot Jet". This technique involves placing two sets of throttle valves in series, all along the span of the slot jet in at least one embodiment. The upstream set of valves is installed within the airknife body, where it provides control over the spanwise distribution of supply air, thereby replacing the need for conventional baffles. This upstream set of valves is adjusted to supply a smoothly increasing air-pressure, with distance from the center of the airknife towards each slot jet end. If this pressure distribution remains preserved downstream, via a series of individual nozzles, which discharge just upstream of the slot jet with uniform gap setting, then it produces a slot jet with maximum bow like velocity or mass flow distribution.

To reduce this bow effect gradually down to zero through online adjustment, a single cylindrical shaft in each airknife is either manually or remotely actuated. This shaft is machined in the form of a multi-port aero-valve in one embodiment. It is either rotated or axially translated within a stationary sleeve which serves as a housing, and has its multi-ports machined to perform either of two functions: 1) gradually throttle-off the excess pressure produced by the upstream set of valves, thereby reducing the simulated bow effect to zero, resulting in uniform velocity and mass flow rate; 2) gradually direct the flow to discharge through a series of fixed flow direction elements such as flow elbows which deflect the flow away from the middle of the span of the airknife, resulting in a combined fan like outflow angle with bow effect. This multi-port aero-valve shaft can easily be actuated remotely from a control room in one embodiment or manually in another embodiment. The optimum amount of bow effect and outflow angle required to improve coating uniformity for any particular line varies with sheet width and thickness, coating thickness, line speed, coating material and chemistry. Currently employed airknives can only alter the amount of bow effect by adjusting the lips in a machine shop, after the airknife has cooled. The herein disclosed valve arrangement, machined within a single shaft, can be adjusted online. One simple technique for remote control is a spring loaded pneumatic actuator, supplied with shop air at the desired pressure using a pressure-regulator. The valve arrangement can also be locally manually controlled in another embodiment.

BRIEF DESCRIPTION OF THE DRAWINGS

FIG. 3A shows the aero-valve in a position required to produce a uniform outflow velocity. This is achieved by throttling off all bow-like excess pressure provided by fixed throttle valves inside the airknife inlet plenum.

FIG. 3B shows the aero-valve in the position required to provide the maximum bow-like pressure distribution as is provided by the fixed throttle valves inside the airknife inlet plenum.

FIG. 3C shows the aero-valve in the position required to provide a combination of maximum bow-like pressure distribution with fan-like outflow angle, via a series of elbows, to minimize edge build-up.

DETAILED DESCRIPTION OF THE EMBODIMENTS

Figure 1:
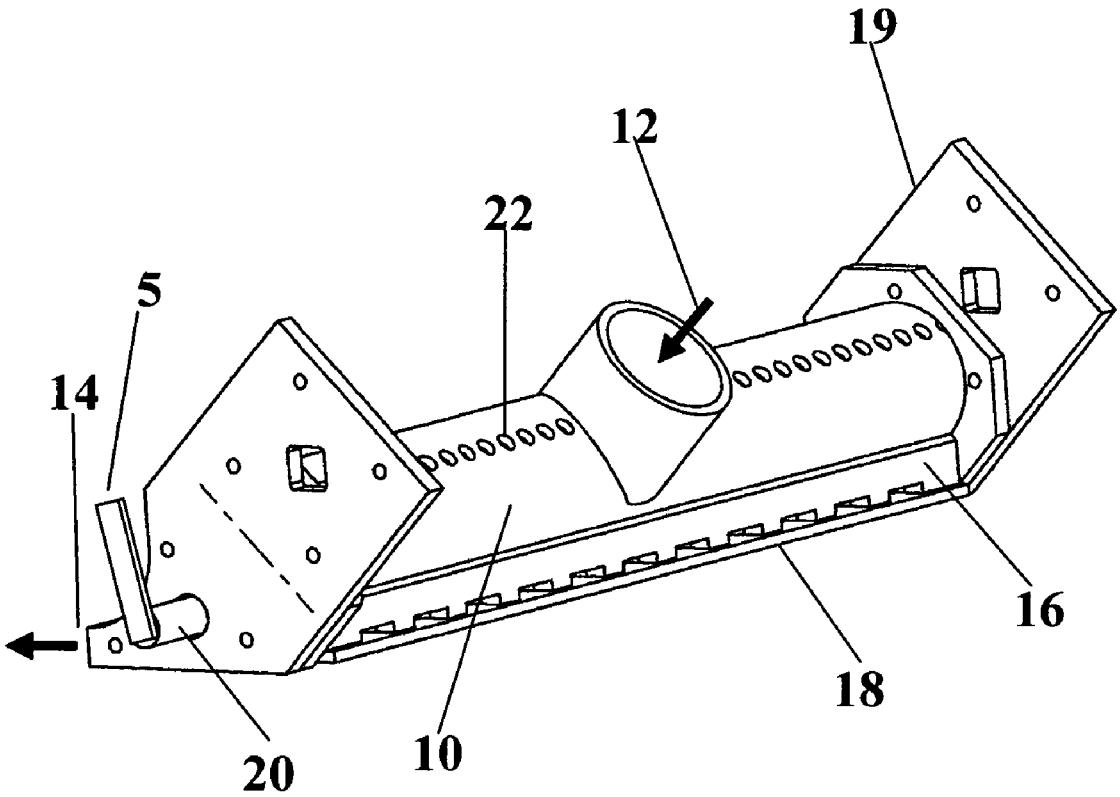
FIG. 1 shows an embodiment of the apparatus configured as an airknife assembly.

FIG. 1 shows an assembly view of the herein disclosed high aspect ratio, slot jet configured as an airknife. A high aspect ratio, slot jet typically comprises a substantially rectangular cross-section jet with its length or span being at least five times its width. The air is supplied to airknife inlet plenum 10 via the airknife blower inlet 12. Inside the airknife inlet plenum 10 is a set of manually pre-set throttle valves 22 to provide a velocity distribution along the span of the airknife nozzle exit slot, thereby simulating the performance of a bow-like exit slot gap setting. The multi-port aero-valve 20 is located downstream of the set of throttle valves 22. This multi-port valve 20 is designed to modulate the pressure distribution provided by throttle valves 22 and acts a proportioning valve in at least one embodiment. If this pressure distribution is left unchanged, then the airknife jet velocity or mass flow rate and momentum exiting the uniform gap exit slot gradually increases with distance from the mid-span of the airknife nozzle exit thereby simulating a bow effect. By translating or rotating the multi-port aero-valve 20, the airknife produced pressure profile, and thus bow effect, can be gradually eliminated resulting in a uniform exit velocity. In one embodiment, the position of the multi-port aero-valve 20 can be controlled by manual adjustment 5. Another option with the multi-port aero-valve 20 is to direct the flow through a series of at least partially spanwise facing flow direction elements such as elbows to produce a fan-like airknife outflow pattern, having spanwise velocity components directed away from the mid-span. This has also proven to be effective in preventing edge build-up on a coated sheet. Edge flanges 19 are used to seal off the ends of the exit slot forming lips and to support the airknife.

Figure 2:
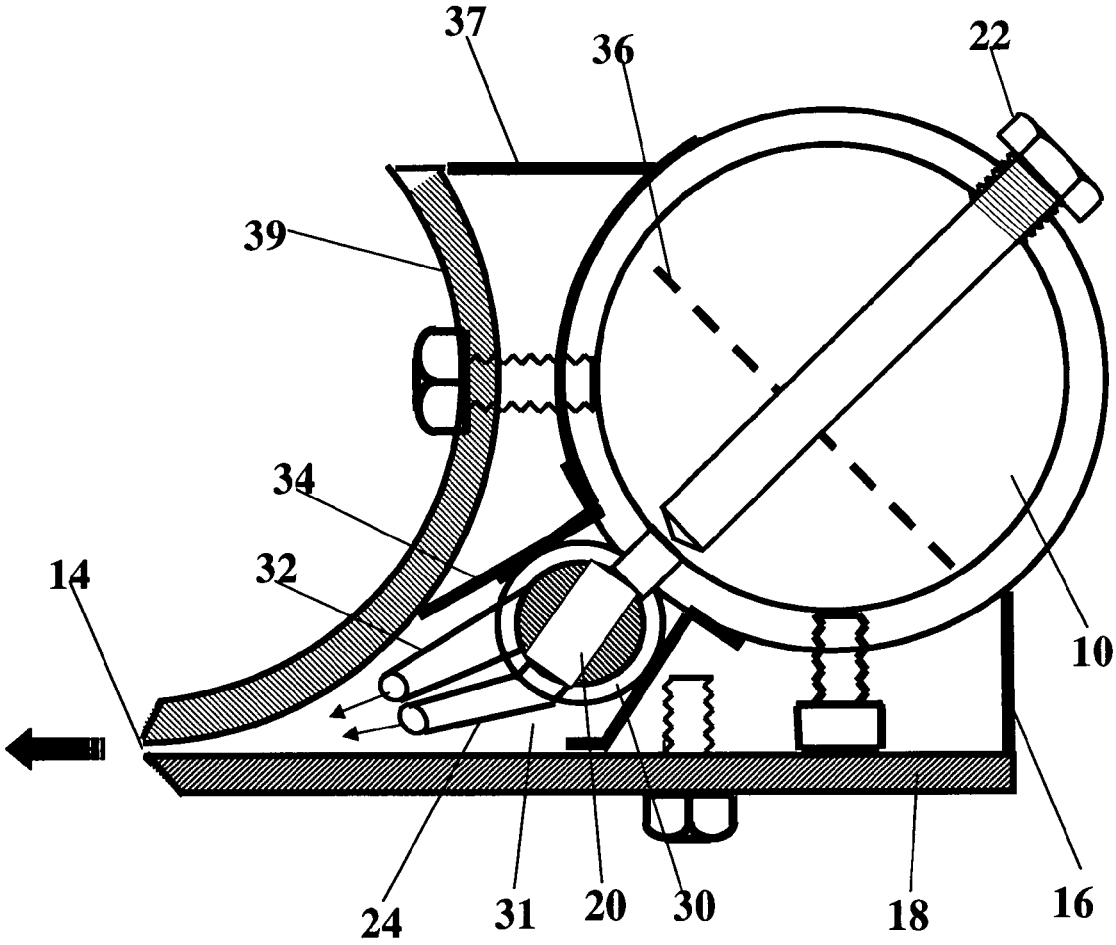
FIG. 2 shows the cross-section of an embodiment of the apparatus with the herein claimed elements which are a series of throttle valves inside the airknife inlet plenum and a multi-port aero-valve, within a stationary housing which discharges either 1) through a series of straight nozzles exiting upstream but in close proximity to the gap in the slot jet or 2) through a series of elbow type nozzles with gradually increasing flow turning angle with distance from the middle of the slot jet.

FIG. 2 shows a typical cross-section of the airknife embodiment of the invention. The bottom lip 18 is attached to the airknife inlet plenum 10 via a bottom saddle 16. The side lip 39 is attached to plenum 10 via a side lip saddle 37. Sheet metal panels 34 are used to minimize air leakage from the slot nozzle cavity 31 in one embodiment. Throttle valves 22 inside airknife plenum 10 are used to pre-set the desired spanwise supply pressure distribution. Plenum screen 36 prevents flow blocking particles from entering the narrow passages of the airknife. Downstream of throttle valves 22 is located the multi-port aero-valve 20, which discharges into the slot nozzle cavity 31 through individual nozzles (nozzles 24 and 32 as shown in FIG. 2, for example). To simulate a bow effect, with a constant gap slot jet, the pressure available for fluid acceleration must increase with spanwise distance from the mid-span of the slot jet. Because the slot nozzle cavity 31 cannot support a spanwise pressure gradient, the pressure profile supplied by the multi-port aero-valve must first be transformed into a spanwise velocity profile using nozzles 24 and 32. These nozzles discharge their velocity profile into the slot nozzle cavity 31 and in close proximity to the uniform gap exit slot 14, so that the spanwise, velocity distribution of the slot jet reflects the upstream individual nozzle velocities. The multi-port aero-valve stationary housing 30 has a plurality of two different outlet nozzle types or flow direction elements. The outlet nozzle 24 provides straight outflow with either a uniform velocity or with a bow simulating velocity profile, and the outlet nozzle 32 type comprises outward pointing flow direction elements (elbows in one embodiment) to produce spanwise flow components directed away from the mid-span and the flowfield may include some bow effect.

Figure 3A:
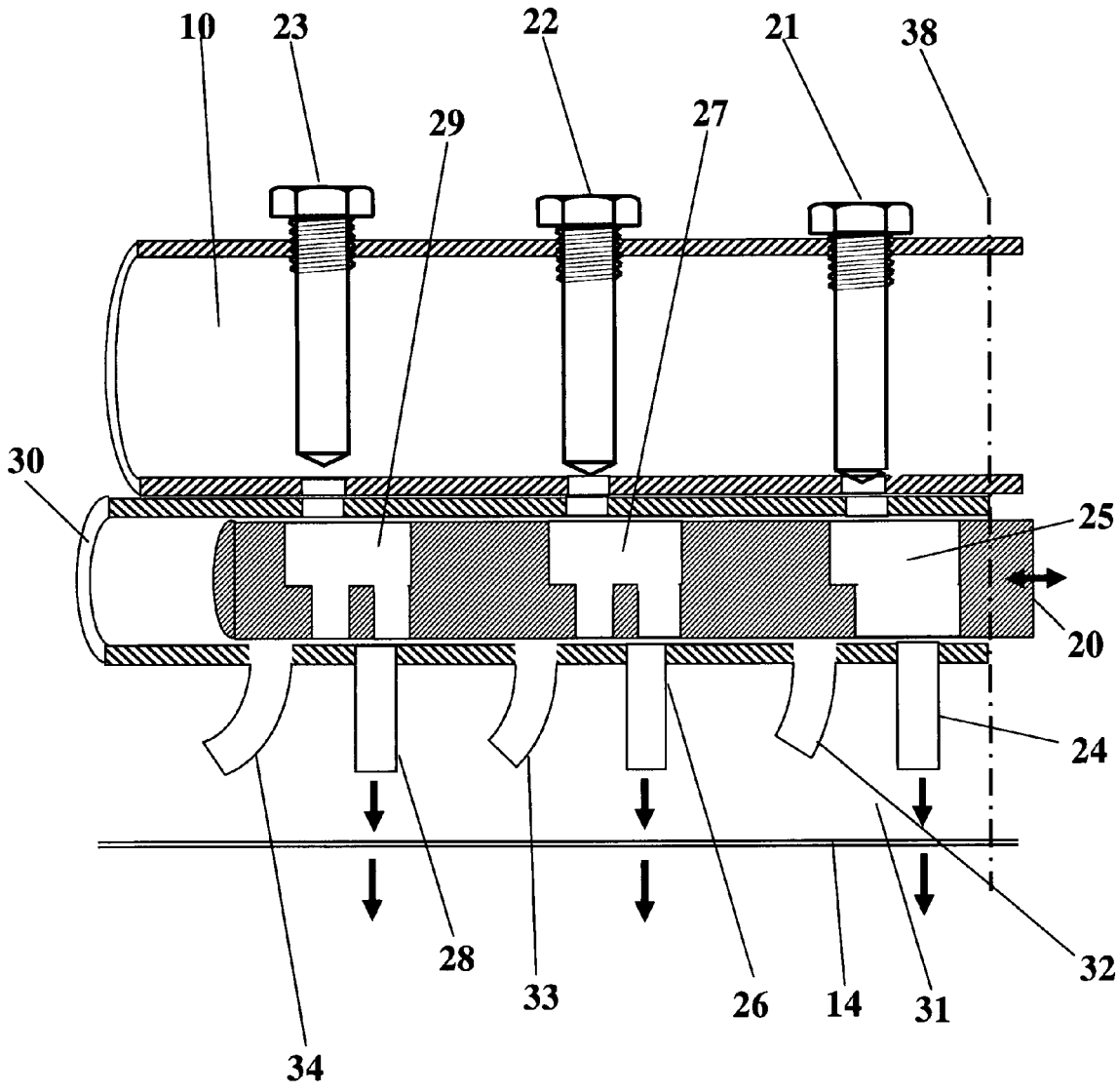
FIGS. 3A, 3B and 3C each show a different position of the multi-port aero-valve.

FIG. 3A shows the multi-port aero-valve in the position required to produce a uniform airknife discharge velocity, thus without bow effect. The multi-port aero-valve 20 can be mechanically actuated, by either a small amount of rotation or translation, or a combination thereof. FIG. 3A shows the multi-port aero-valve 20 actuated in translation. The airknife inlet plenum 10 is shown with the multi-port aero-valve 20 below it and downstream of it. A plurality of throttle valves 22 is required to simulate the desired bow effect. For clarity, only three valves are shown. Valve 21, located adjacent to the centerline 38 of the airknife, (and any other such valves so located) is adjusted to reduce supply pressure the most. Valve 22, (farther from the centerline 38 and any other such valves so located) is adjusted to reduce supply pressure to a lesser degree. Valve 23 (farther still from the centerline 38 and any other such valves so located) reduces the supply pressure the least, and is only required to assure symmetry in outflow from the airknife. Downstream of each of these throttle valves is attached a stationary housing 30 containing a multi-port aero-valve. For straight flow, it discharges through outlet nozzles (24, 26, and 28) also known herein as a type of flow direction element. In this position of the multi-port aero-valve, passage 25 entirely uncovers the inlet to outlet nozzle 24, positioned near the airknife centerline 38. Passage 27 partially blocks the inlet to outlet nozzle 26. Passage 29 partially blocks and to a greater extend the inlet to outlet nozzle 28. The amount of flow blockage into these nozzles (24, 26, and 28) is designed to cancel any supply pressure in excess of that supplied by throttle valve 21 adjacent to the centerline 38. The result is a uniform mass flow rate and velocity discharged by each outlet nozzle (24, 26 and 28) and likewise uniform velocity out of uniform gap exit slot 14. This position of the multi-port aero-valve simulates an airknife without bow setting. It is understood that many more than three throttle valves, straight and curved outflow nozzles may be employed in various embodiments. The single-headed arrows shown in FIGS. 3A, 3B, and 3C illustrate the fluid velocity vectors produced by the apparatus as a function of varying position of the multi-port aero-valve system (a proportioning valve system).

Figure 3B:
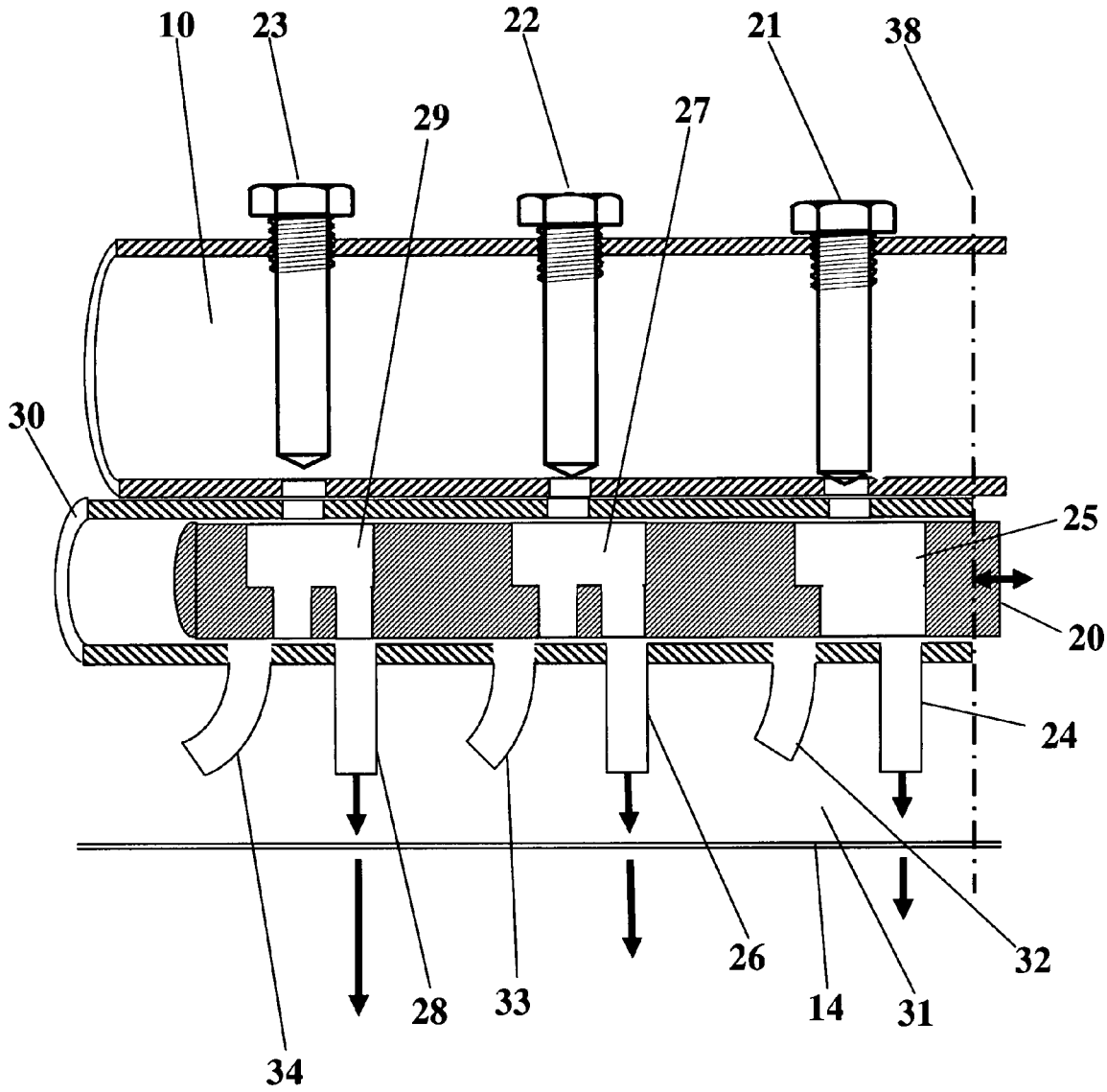

FIG. 3B shows the multi-port aero-valve in the position required to simulate the maximum bow effect. The airknife inlet plenum 10 is shown here with the multi-port aero-valve 20 below it and downstream of it. A plurality of throttle valves 22 is required to simulate the desired bow effect. But for clarity, only three valves are shown here. Valve 21, located adjacent to the centerline 38 of the airknife, (and any other such valves so located) is adjusted to reduce flow rate the most. Valve 22, (farther from the centerline 38 and any other such valves so located) is adjusted to reduce the flow rate to a lesser degree. Valve 23 (farther still from the centerline 38 and any other such valves so located) reduces the local flow rate the least, and is only required to assure symmetry in outflow from the airknife. Downstream of each of these throttle valves is attached a stationary housing 30 containing a multi-port aero-valve. For straight flow, it discharges through outlet nozzles (24, 26, and 28). In this position of the multi-port aero-valve 20, all inlet ports to the outlet nozzles are totally uncovered by passages (25, 27 and 29). The amount of flow passing through outlet nozzles 24, 26, and 28 is proportional to the pressure supplied by the upstream throttle valves (21, 22 and 23). The result is maximum airknife bow effect as indicated by arrows leaving outlet nozzles (24,26 and 28) and also leaving uniform gap exit slot 14. Due to the movement of the multi-port aero-valve (a proportioning valve) from position shown in FIG. 3A to that in FIG. 3B, the airknife outflow velocity transitions smoothly from uniform flow to maximum bow effect flow.

Figure 3C:
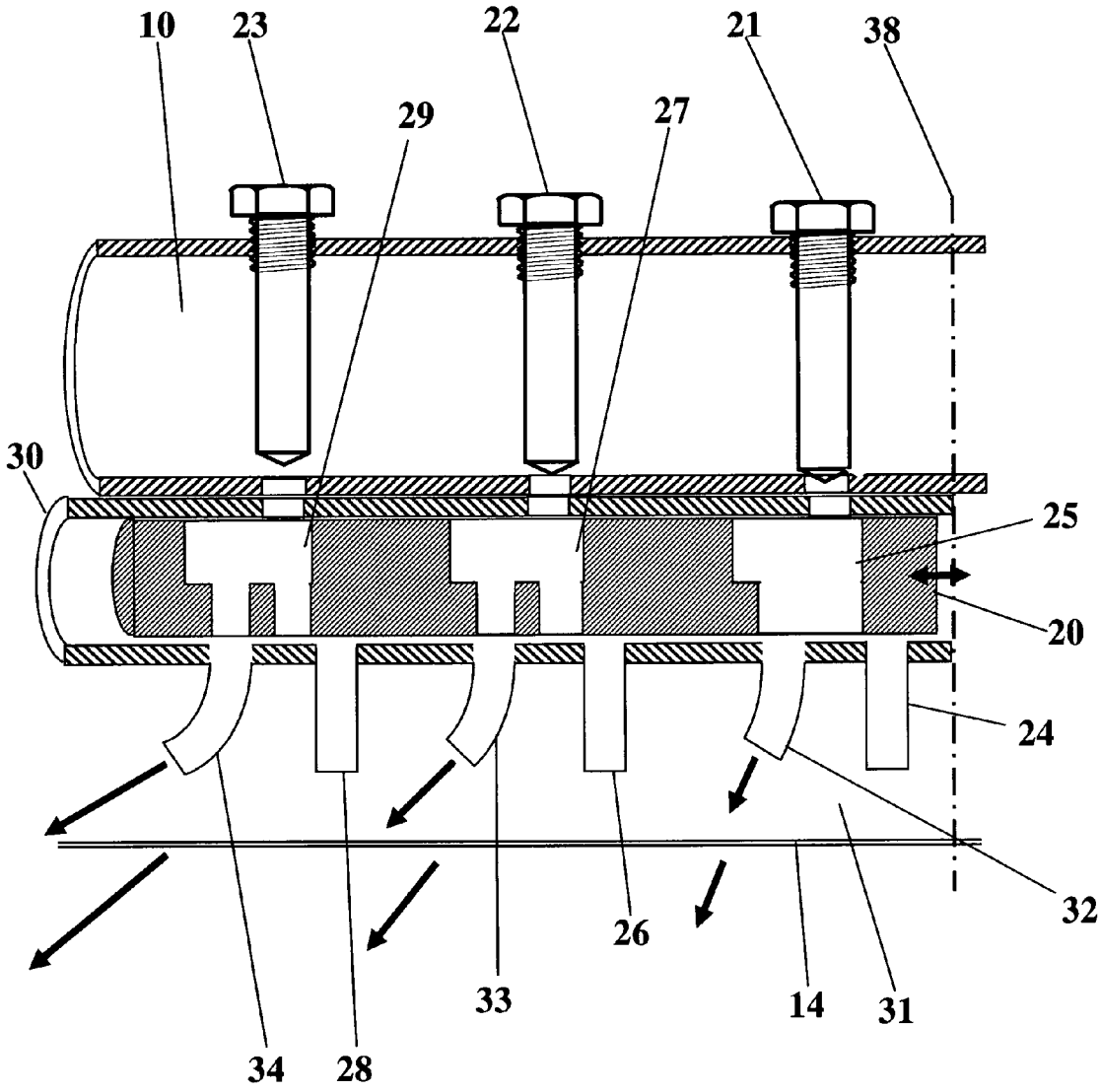

FIG. 3C shows the multi-port aero-valve in the position required to simulate a combination of maximum bow effect with fan-like outflow. The airknife inlet plenum 10 is shown here with the multi-port aero-valve 20 below and downstream. A plurality of throttle valves 22 is required to simulate an accurate bow effect. But for clarity, only three valves are shown here. Valve 21, located adjacent to the centerline 38 of the airknife, (and any other such valves so located) is adjusted to reduce flow rate the most. Valve 22, (farther from the centerline 38 and any other such valves so located) is adjusted to reduce the flow rate to a lesser degree. Valve 23 (farther still from the centerline 38 and any other such valves so located) reduces the local flow rate the least, and is only required to assure symmetry in outflow from the airknife. Downstream of each of these three throttle valves, is attached a stationary housing 30 containing a multi-port aero-valve. The flow is directed through elbow shaped nozzles (32, 33 and 34) also known herein as a type of flow direction element. The inlets to these elbows are totally uncovered by the passages (25, 27 and 29) of the multi-port aero-valve 20, and in at least one embodiment, each elbow may have a different outlet flow angle. The amount of flow leaving these elbows is proportional to the pressure supplied by the throttle valves. The result is the maximum airknife bow effect in combination with a fan-like outflow angle, as indicated by the arrows. By moving the multi-port aero-valve from position shown in FIG. 3B to that in FIG. 3C, the airknife outflow velocity with bow effect transitions smoothly from straight outflow to fan-like, spanwise outflow by engaging selected flow direction elements. Such a slot jet profile has proven to be beneficial to minimize edge coating build-up on sheet goods.

Figure 4:
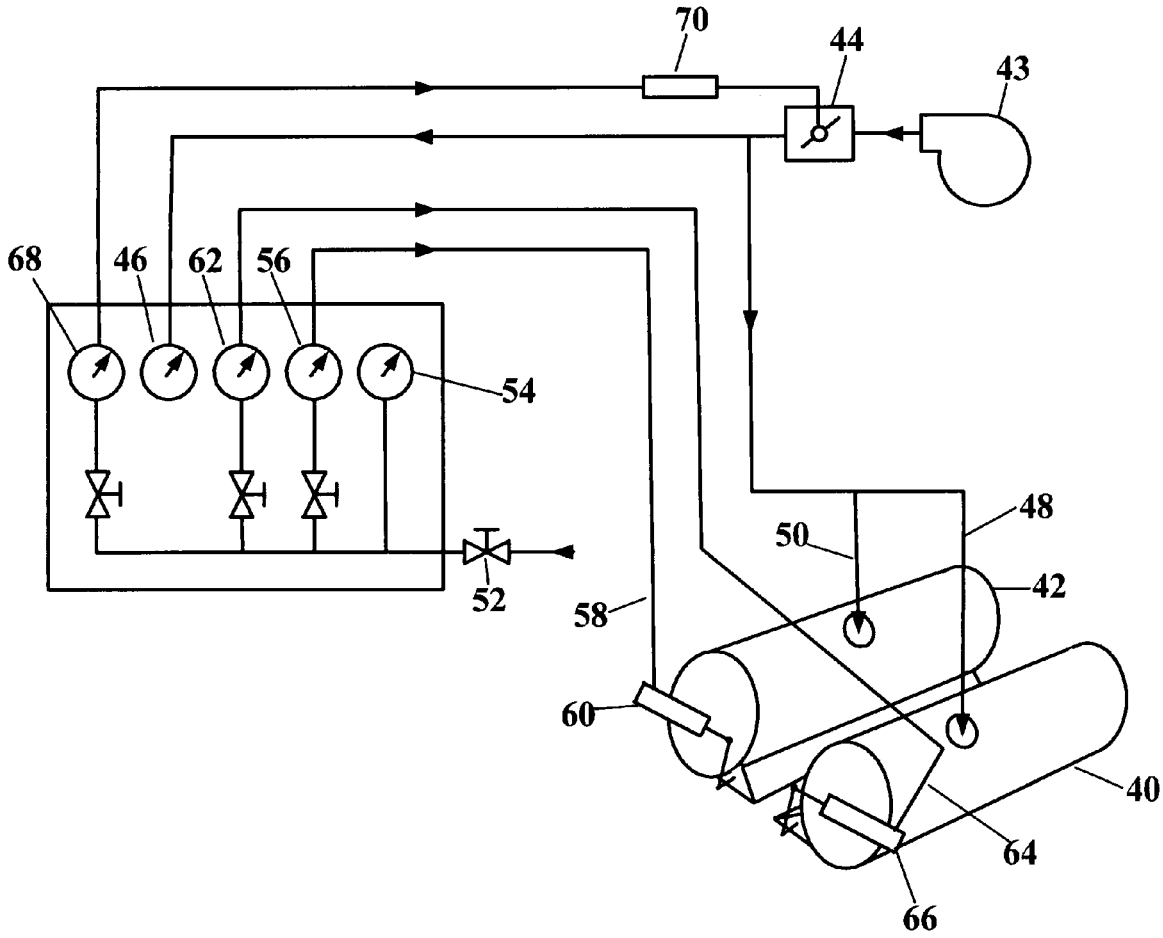
FIG. 4 shows a schematic of pneumatic air-lines used to remotely control the multi-port aero valve within each airknife and also control the blower air supply pressure.
Figure 5:
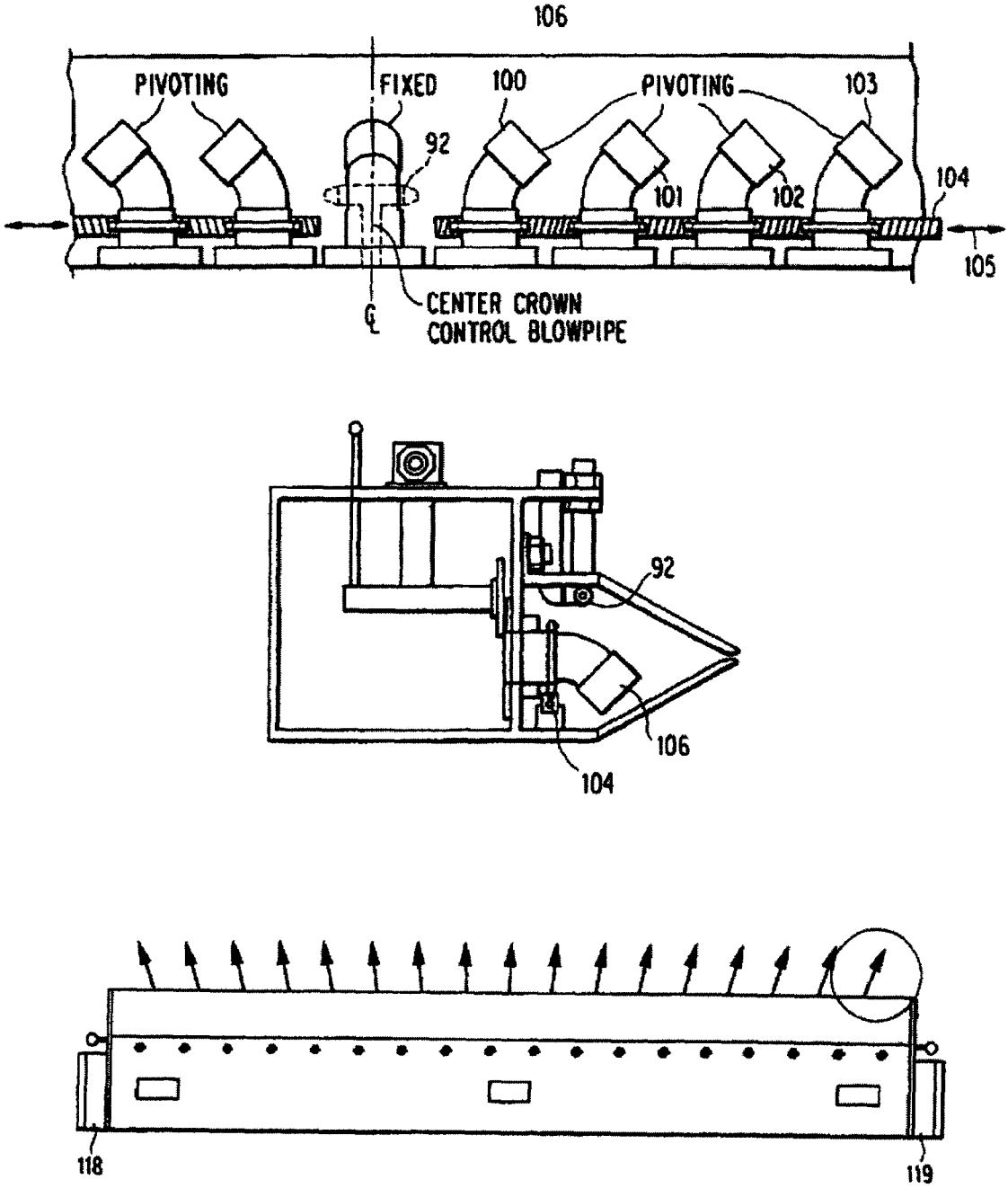
Fig. 5 (Prior Art)
FIG. 5 shows a prior art (U.S. Pat. No. 5,683,514) fan-like outflow pattern obtainable by adding swiveling elbows inside the airknife inlet plenum.

FIG. 4 shows a schematic for remote control over the multi-port aero-valve and the blower supply pressure. For application for a hot dip galvanizing line, two airknives (right air knife 40 and left airknife 42) are used. The airknives 40 and 42 are supplied with air from blower 43, via a pressure controlling damper 44. The blower supply pressure can be monitored inside the control room by pressure gauge 46. Air is supplied to airknife 40 via pipe 48 and to airknife 42 via pipe 50. For remote control of the multi-port aero-valves and the blower supply pressure, compressed air is used as supplied to the inlet of valve 52 the outlet pressure of which is shown on pressure gauge 54. A spring loaded, high temperature, piston-type, pneumatic actuator 66 is used to control the multi-port aero-valve on airknife 40 in one embodiment. Compressed air is supplied to the pneumatic actuator 66 via air-line 64. The piston position within the actuator depends on the pressure supplied by a regulator and shown on pressure gauge 56. A shaft connects the piston within the actuator to the multi-port aero-valve 20 such that the piston position controls the position of the multi-port aero-valve and thus the flow pattern exiting the airknife 40. A spring loaded, high temperature, piston-type, pneumatic actuator 60 is used to control the multi-port aero-valve on airknife 42 in one embodiment. Compressed air is supplied to the pneumatic actuator 60 via air-line 58. The piston position within the actuator depends on the pressure supplied by a regulator and shown on pressure gauge 62. A shaft connects the piston within the actuator to the multi-port aero-valve 20 such that the piston position controls the position of the multi-port aero-valve and thus the flow pattern exiting the airknife 42.

A spring loaded high temperature pneumatic actuator 70 is used to control the blower damper setting 44. This pneumatic actuator piston position depends on the pressure supplied by a regulator as shown by pressure gage 68.

The various embodiments described within are merely descriptions and are in no way intended to limit the scope of the invention. Modifications of the present invention will become obvious to one skilled in the art in light of the above descriptions and such modifications are intended to fall within the scope of the appended claims. It is understood that no limitation with respect to the specific apparatus and methods illustrated herein is intended or should be inferred.

The invention claimed:

1. An airknife apparatus for controlling a coating applied to sheet goods comprising:

a pressurized air source;

an inlet plenum, receiving pressurized air from the pressurized air source, having an inlet, a span, and a plurality of spanwise located outlet ports;

a plurality of throttle valves positioned along the plenum span to adjust the spanwise distribution of air mass flow rate exiting the plenum outlet ports;

an adjustable proportioning valve positioned within a housing downstream of the plenum outlet ports distributes a fractional amount of the air flow exiting each plenum outlet port into a flow direction element; and the air flow exiting the flow direction element enters into a high aspect ratio, slot nozzle having a span whereby the air exits the slot nozzle to form an air jet with the local flow velocity along the span of the nozzle controlled by the position of the proportioning valve within the housing.

2. The airknife apparatus of claim 1 wherein the at least one flow direction element comprises an elbow-shaped flow nozzle.

3. The airknife apparatus of claim 1 wherein the at least one flow direction element comprises a straight nozzle.

4. The airknife apparatus of claim 1 whereby the position of the proportioning valve is controlled by a pneumatic actuator.

5. The airknife apparatus of claim 1 whereby the position of the proportioning valve is controlled by manual adjustment.

6. The airknife apparatus of claim 1 wherein the at least one flow direction element is attached to the housing.

7. The airknife apparatus of claim 1 wherein a selected position of the proportioning valve creates a bow-like flow field of air exiting the slot nozzle whereby wiping action by the air on the sheet goods is enhanced near edges of the sheet.

8. The airknife apparatus of claim 1 wherein the proportioning valve can be adjusted during on-line operation of the airknife apparatus.

9. An airknife system apparatus for controlling a coating applied to sheet goods comprising:

a inlet plenum having a span, a width, at least one inlet, and a plurality of outlet ports spaced along the span of the inlet plenum;

a pressurized fluid source connected to the at least one inlet of the inlet plenum supplying pressurized fluid to the inlet plenum;

a multi-port aero-valve system, enclosed in a housing, comprising a plurality of passages, each passage comprising one inlet and at least one outlet, the multi-port aero-valve system moveably attached to the housing whereby the outlet ports of the inlet plenum exhaust into the inlets of the passages of the multi-port aero-valve system;

the multi-port aero-valve system housing at least partially enclosed by a side lip and a bottom lip forming a high aspect ratio, slot nozzle, having a span and a width, into which fluid enters from outlets of the passages of the multi-port aero-valve system and through which the fluid flows thereby forming a high aspect ratio jet of fluid issuing from the slot nozzle whereby the position of the multi-port aero-valve system within the housing adjusts the local velocity distribution along the span of the fluid jet issuing from the nozzle by directing fractional amounts of the fluid flow exiting at least one multi-port aero-valve system passage outlet into at least one flow direction element fixed to the housing;

the fluid flow within the at least one flow direction element exits just upstream of the exit of the slot nozzle; and fluid exiting the airknife system apparatus through the slot nozzle contacts the coating applied to sheet goods thereby controlling coating parameters.

10. The airknife apparatus of claim 9 wherein the at least one flow direction element comprises an elbow-shaped flow nozzle.

11. The airknife apparatus of claim 9 wherein the at least one flow direction element comprises a straight nozzle.

12. The airknife apparatus of claim 9 wherein the multi-port aero-valve system is positioned relative to the housing by a remote control mechanism.

13. The airknife apparatus of claim 9 wherein the multi-port aero-valve system is positioned relative to the housing by a manual control mechanism.

14. An airknife apparatus for controlling a coating applied to sheet goods comprising:

a blower inlet to receive pressurized fluid;

the pressurized fluid flowing through a multi-port aero-valve system and then through multiple straight or elbow type nozzles within a cavity having a span and a width;

the cavity at least partially enclosed by a side lip and a bottom lip forming a high aspect ratio, nozzle exit slot through which the pressurized fluid flows;

the multi-port aero-valve system, enclosed by a housing, comprising a plurality of passages, each passage comprising an inlet and at least one outlet;

the multi-port aero-valve system moveably attached to the housing whereby the position of the multi-port aero-valve system within the housing adjusts the local velocity distribution along the span of the high aspect ratio nozzle exit slot; and the airknife apparatus is positioned relative to the sheet goods such that fluid exiting the nozzle exit slot contacts the coating applied to the sheet goods thereby controlling coating parameters.

* * * * *